US009963843B2

(12) United States Patent
Boise et al.

(10) Patent No.: US 9,963,843 B2
(45) Date of Patent: May 8, 2018

(54) PAVEMENT MARKING METHOD AND COMPOSITION

(71) Applicants: Lawrence H. Boise, Uxbridge, MA (US); Stephen S. Schultz, Franklin, MA (US)

(72) Inventors: Lawrence H. Boise, Uxbridge, MA (US); Stephen S. Schultz, Franklin, MA (US)

(73) Assignee: LIRON HOLDINGS, LLC, Providence, RI (US)

( * ) Notice: Subject to any disclaimer, the term of this patent is extended or adjusted under 35 U.S.C. 154(b) by 192 days.

(21) Appl. No.: 15/008,636

(22) Filed: Jan. 28, 2016

(65) Prior Publication Data

US 2017/0218582 A1 Aug. 3, 2017

(51) Int. Cl.
*E01F 9/576* (2016.01)
*B05D 1/00* (2006.01)

(52) U.S. Cl.
CPC ..... *E01F 9/576* (2016.02); *B05D 1/00* (2013.01)

(58) Field of Classification Search
CPC ..... C09D 7/12
USPC ..... 521/55
See application file for complete search history.

(56) References Cited

U.S. PATENT DOCUMENTS 7,413,316 B2 8/2008 Shipman et al.
7,458,693 B2 12/2008 Shipman et al.
2009/0253845 A1 10/2009 Neugebauer et al.
2010/0210745 A1* 8/2010 McDaniel ..... C09D 5/008 521/55
2011/0059295 A1* 3/2011 Greer ..... G02B 5/128 428/149
2012/0269963 A1 10/2012 Neugebauer et al.

FOREIGN PATENT DOCUMENTS

WO 0015351 A1 3/2000

OTHER PUBLICATIONS

"DEGAROUTE® Reactive Resins for Road Markings Application Information," published by EVONIK Industries, retrieved from www.degaroute.com <http://www.degaroute.com> on Dec. 15, 2015.
Federal Aviation Administration Advisory Circular No. 150/5370-10G, Standards for Specifying Construction of Airports, Item P-620 Runway and Taxiway Marking, pp. 424-438, Jul. 21, 2014.
Innovative Pavement Research Foundation, Report IPRF 01-G-002-05-1, Airfield Marking Handbook, Sep. 2008.
Declaration of Lawrence H. Boise dated Mar. 15, 2016.

* cited by examiner

*Primary Examiner* — Dah-Wei D Yuan
*Assistant Examiner* — Andrew Bowman
(74) *Attorney, Agent, or Firm* — Lando & Anastasi, LLP

(57) ABSTRACT

Systems and methods are provided for depositing a structured paint material on a surface. According to one embodiment, the method comprises introducing an initiator to a paint composition comprising methyl methacrylate (MMA) and a first retroreflective element to produce a liquid mixture, depositing the liquid mixture on a surface of a substrate to produce a layer of structured paint material, and depositing a layer of a second retroreflective element onto at least a portion of an upper surface of the deposited layer of structured paint material, and wherein a coefficient of retroreflected luminance of the layer of structured paint material is at least 1400 mcd/m$^2$/lux.

19 Claims, 7 Drawing Sheets

PAVEMENT MARKING METHOD AND COMPOSITION

BACKGROUND

Technical Field

The technical field relates generally to methods and systems for depositing paint compositions, and more specifically, to depositing paint compositions suitable for use on airport runways and vehicle roadways.

Background Discussion

Pavement markings are often used to provide visual guidance to drivers and pilots by incorporating colored and/or retroreflective materials for purposes of safe navigation. Many of these markings are constructed from thermoplastic materials or other compositions that are not only expensive, but lack durability over time, especially in high traffic areas. As a result, these markings often have to be reapplied several times a year to remain in compliance with government standards for visibility. This further escalates the associated costs with using these materials, and during times of reapplication, is disruptive to the flow of traffic through these areas.

SUMMARY

Aspects and embodiments are directed to systems and methods of depositing a paint composition on a surface. According to at least one embodiment, a method of depositing a structured paint material on a surface comprises introducing an initiator to a paint composition comprising methyl methacrylate (MMA) and a first retroreflective element to produce a liquid mixture, depositing the liquid mixture on a surface of a substrate to produce a layer of structured paint material, and depositing a layer of a second retroreflective element onto at least a portion of an upper surface of the deposited layer of structured paint material, wherein a coefficient of retroreflected luminance of the layer of structured paint material is at least 1400 mcd/m$^2$/lux.

According to one embodiment, introducing the initiator to the paint composition comprises supplying the paint composition and the initiator under pressurized conditions to a first end of a nozzle and randomly distributing the initiator and the paint composition within the nozzle. In one embodiment, the first nozzle is configured as a static mixer. According to a further embodiment, randomly distributing the initiator and the paint composition comprises introducing the initiator and the paint composition to one or more fluid channels, wherein the one or more fluid channels are configured to randomize the distribution of the initiator and the paint composition within the nozzle.

According to another embodiment, the coefficient of retroreflected luminance of the layer of structured paint material is at least 1450 mcd/m$^2$/lux. In another embodiment, the coefficient of retroreflected luminance of the layer of structured paint material is at least 1800 mcd/m$^2$/lux.

According to some embodiments, coverage of the surface of the substrate by the layer of structured paint material is about 80%, and the layer of structured paint material has a thickness in a range of about 0.0 inches to about 0.250 inches. According to another embodiment, the layer of structured paint material is deposited at a rate of 60 ft$^2$/gal. According to one embodiment, the layer of structured paint material has an average thickness in a range of about 0.09 inches to about 0.125 inches.

According to one embodiment, the paint composition comprises at least 5% by weight MMA. According to another embodiment, the paint composition comprises at least 10% by weight MMA.

According to another embodiment, the initiator is a peroxide. In one embodiment, the weight ratio of peroxide to paint composition in the liquid mixture is in a range from 99-80:1-20. According to a further embodiment, the peroxide is benzoyl peroxide. In one embodiment, the weight ratio of benzoyl peroxide to paint composition in the liquid mixture is in a range from 99-80:1-20.

According to one embodiment, the method further comprises depositing the liquid mixture at a temperature below about 0° C. According to another embodiment, the liquid mixture may be deposited at temperatures as low as −40° C.

According to another embodiment, depositing the liquid mixture creates a three-dimensional (3D) topography on a surface of the layer of structured paint material formed at least in part by at least one of the first and the second retroreflective elements. According to at least one embodiment, the first and the second retroreflective elements comprise a plurality of glass beads. According to another embodiment, the layer of second retroreflective element comprising the glass beads is deposited such that each bead is embedded to a depth of at least 60% of a diameter of each bead.

According to another embodiment, the cure time for the deposited liquid mixture is about 15 minutes.

According to at least one embodiment, the layer of structured paint material is deposited to form a pavement marking.

At least one aspect of the invention is directed to a pavement marking. The pavement marking may be formed from a layer of structured paint material comprising methyl methacrylate (MMA) and having a three-dimensional topography created by a plurality of glass beads at least partially embedded in the layer of structured paint material. The layer of structured paint material may be deposited such that the pavement marking exhibits a coefficient of retroreflected luminance of at least 1400 mcd/m$^2$/lux. According to one embodiment, the layer of structured paint material comprises a paint composition and an initiator, the paint composition comprising at least 5% by weight of the MMA and at least 30% by weight glass beads.

According to another embodiment, the paint composition further comprises at least 20% by weight filler and at least 1% by weight colorant. According to a further embodiment, the filler is calcium carbonate. According to at least one embodiment, the pavement marking of claim has a shore D hardness of at least 40.

According to another embodiment, at least a portion of the plurality of glass beads comprise Type I glass beads having an index of refraction of at least 1.5, and a sieve size of less than 70. According to one embodiment, the plurality of glass beads are embedded at a plurality of different angles.

According to at least one embodiment, the pavement marking has a life expectancy of at least three years. According to another embodiment, the pavement marking exhibits a coefficient of retroreflected luminance of at least 1800 mcd/m2/lux. According to another embodiment, the pavement marking is hydrophobic.

Still other aspects, embodiments, and advantages of these example aspects and embodiments, are discussed in detail below. Moreover, it is to be understood that both the foregoing information and the following detailed description are merely illustrative examples of various aspects and embodiments, and are intended to provide an overview or framework for understanding the nature and character of the claimed aspects and embodiments. Embodiments disclosed herein may be combined with other embodiments, and references to "an embodiment," "an example," "some embodiments," "some examples," "an alternate embodiment," "various embodiments," "one embodiment," "at least one embodiment," "this and other embodiments," "certain embodiments," or the like are not necessarily mutually exclusive and are intended to indicate that a particular feature, structure, or characteristic described may be included in at least one embodiment. The appearances of such terms herein are not necessarily all referring to the same embodiment.

BRIEF DESCRIPTION OF DRAWINGS

Various aspects of at least one embodiment are discussed below with reference to the accompanying figures, which are not intended to be drawn to scale. The figures are included to provide an illustration and a further understanding of the various aspects and embodiments, and are incorporated in and constitute a part of this specification, but are not intended as a definition of the limits of any particular embodiment. The drawings, together with the remainder of the specification, serve to explain principles and operations of the described and claimed aspects and embodiments. In the figures, each identical or nearly identical component that is illustrated in various figures is represented by a like numeral. For purposes of clarity, not every component may be labeled in every figure. In the figures:

DETAILED DESCRIPTION

Figure 1:
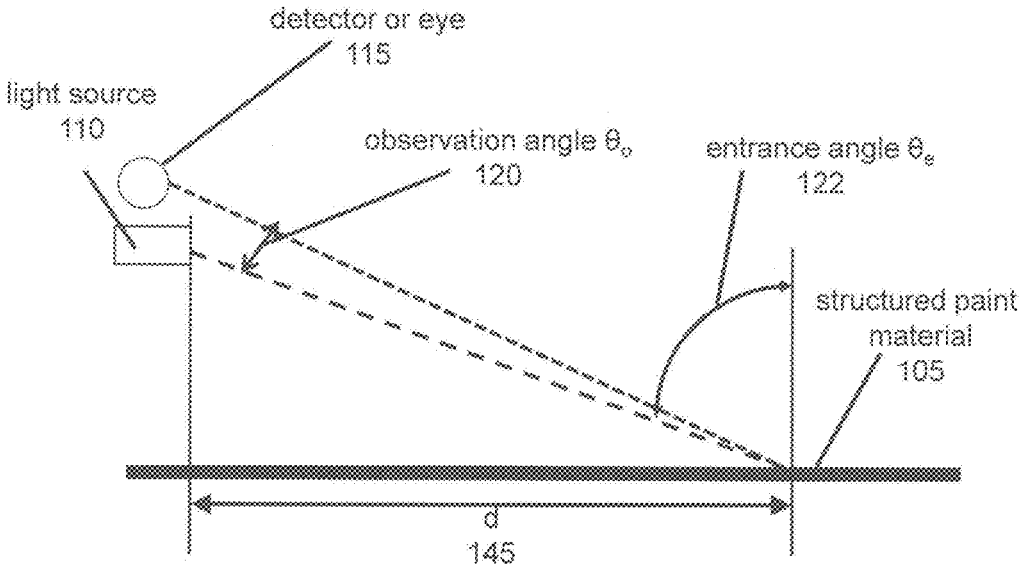
FIG. 1 is a diagram illustrating an aspect of retroreflection, in accordance with one or more aspects of the present invention.

In dark environmental conditions, e.g., nighttime, typical pavement markings rely on retroreflective elements, such as transparent spheres, that are included in a layer of material that functions as a binder. Retroreflectivity refers to a physical property of reflecting light back in an incident direction of the light, and therefore defines how much light is reflected back to a certain vantage point. In use, light from a light source, such as the headlights of an automobile or plane enter the spheres or other retroreflective material and reflects back so as to be visible to the driver or pilot. For example, FIG. 1 illustrates the geometry behind the concept of retroreflection, and includes the source of retroreflectivity, which in this example is a structured paint material 105 that may be deposited on a substrate such as the surface of a roadway, a light source 110 such as a headlamp from an airplane or automobile, and an observer's eye or detector such as a photometer 110. The observation angle $\theta_o$ 120 represents the angle between the line formed from the light source 110 to the retroreflective material in the structured paint material 105 and the line formed from the eye of the observer 115 and the retroreflective material. Generally speaking, the retroreflected light is strongest at smaller observation angles, which corresponds to larger retroreflectivity values. Likewise, the retroreflected light is weaker at larger observation angles, which corresponds to smaller retroreflectivity values. The entrance angle $\theta_e$ 122 is the angle at which the light from the light source 115 enters the surface of the retroreflective material, and is shown in FIG. 1 as the angle between the line formed from the light source 110 to the retroreflective material (105) and an imaginary line perpendicular to the retroreflective material. Unlike the observation angle, retroreflectivity is greater at high entrance angles.

The retroreflectivity of pavement markings may be measured in units of millicandelas per meter squared per lux ($mcd/m^2/lux$) using a standard measurement geometry, such as the value of "d" 145 shown in FIG. 1, which represents the horizontal distance from the light source 115 to the marking (105). For instance, according to certain government standards for retroreflectivity, distance d 145 may be a value of 30 meters, the entrance angle 122 is 88.76°, and the observation angle 120 is 1.05°. Performance values for retroreflectivity may therefore be an expression of the efficiency of a particular material to retroreflect light at a specific "geometry" (e.g., distance d 145, observation angle 120, and entrance angle 122). One such performance value, the coefficient of retroreflection $R_A$, indicates how much light is retroreflected at that particular "geometry" for a given unit of light falling on a given area of the material, and may be expressed in candelas per lux per square meter ($cd/lux/m^2$). Another such performance metric is the coefficient of retroreflected luminance $R_L$, which is a measure of retroreflection typically used to describe the retroreflectivity of pavement markings (and was mentioned above), and is the ratio of the luminance of a projected surface of retroreflective material to the normal illuminance at the surface on a plane normal to the incident light, and is expressed in units of candelas per square meter per lux ($cd/m^2/lux$). The performance of the pavement markings using the disclosed method and compositions may be evaluated by determining the Coefficient of Retroreflected Luminance ($R_L$) as described in ASTM E1710, ASTM E2176-01 and ASTM E2177-01 using an entrance angle of 88.76 degrees, and an observation angle of 1.05 degrees.

Federally mandated retroreflectivity metrics for pavement markings at airports and roadways may be difficult to maintain in inclement conditions, such as during rainstorms, where a layer of water may coat or otherwise cover the retroreflective elements in the paint compositions. Retroreflectivity is also affected by physical elements, such as snowplows and tires that physically contact and remove portions of the layer of paint composition itself, and/or remove portions that contain the retroreflective elements. Thermocycling between freezing and thawing and/or hot and cold environmental conditions also affect the durability and functionality of the paint composition.

Aspects and embodiments are directed to a method for depositing a paint composition on a surface of a substrate, such as pavement. According to certain embodiments, the method includes a plural component marking system that comprises a synthetic resin, an initiator, and a retroreflective element to create a deposited layer of structured paint material with superior physical and functional properties, as discussed in more detail below. According to various embodiments, the paint compositions disclosed herein comply with federally mandated standards for pavement marking systems, such as FAA standard AC 150/5370-10G "Standards for Specifying Construction of Airports."

The methods and systems disclosed herein offer many advantages over other marking systems that are currently available and are used for marking aviation and/or roadway surfaces. For example, the FAA mandates a minimum retroreflectivity requirement of 150 mcd/m$^2$/lux for airport runways or other active portions of an airport. Although some commercially available systems are capable of achieving retroreflectivity values of approximately 800 mcd/m$^2$/lux, the systems disclosed herein are capable of achieving an average retroreflectivity value of at least 1400 mcd/m$^2$/lux (yellow, dry conditions), at the time of installation, and in some embodiments achieve an average retroreflectivity value of at least 1800 mcd/m$^2$/lux (white, dry conditions), at the time of installation. Furthermore, instead of having to be applied multiple times per year, as is the case with typical marking systems, various embodiments disclosed herein include paint compositions with a life expectancy of at least three years. In addition, various embodiments disclosed herein include deposition at temperatures as low as −40° C., making them suitable for use in colder climates and/or conditions, and may be deposited at thicknesses of up to 0.250 inches. The paint compositions disclosed herein are also capable of curing quickly, and the rate of cure is independent of temperature, making it ideal for applications in extreme environmental conditions.

The aspects disclosed herein in accordance with the present invention, are not limited in their application to the details of construction and the arrangement of components set forth in the following description or illustrated in the accompanying drawings. These aspects are capable of assuming other embodiments and of being practiced or of being carried out in various ways. Examples of specific implementations are provided herein for illustrative purposes only and are not intended to be limiting. In particular, acts, components, elements, and features discussed in connection with any one or more embodiments are not intended to be excluded from a similar role in any other embodiments.

Also, the phraseology and terminology used herein is for the purpose of description and should not be regarded as limiting. Any references to examples, embodiments, components, elements or acts of the systems and methods herein referred to in the singular may also embrace embodiments including a plurality, and any references in plural to any embodiment, component, element or act herein may also embrace embodiments including only a singularity. References in the singular or plural form are not intended to limit the presently disclosed systems or methods, their components, acts, or elements. The use herein of "including," "comprising," "having," "containing," "involving," and variations thereof is meant to encompass the items listed thereafter and equivalents thereof as well as additional items. References to "or" may be construed as inclusive so that any terms described using "or" may indicate any of a single, more than one, and all of the described terms. In addition, in the event of inconsistent usages of terms between this document and documents incorporated herein by reference, the term usage in the incorporated reference is supplementary to that of this document; for irreconcilable inconsistencies, the term usage in this document controls. Moreover, titles or subtitles may be used in the specification for the convenience of a reader, which shall have no influence on the scope of the present invention.

Figure 2:
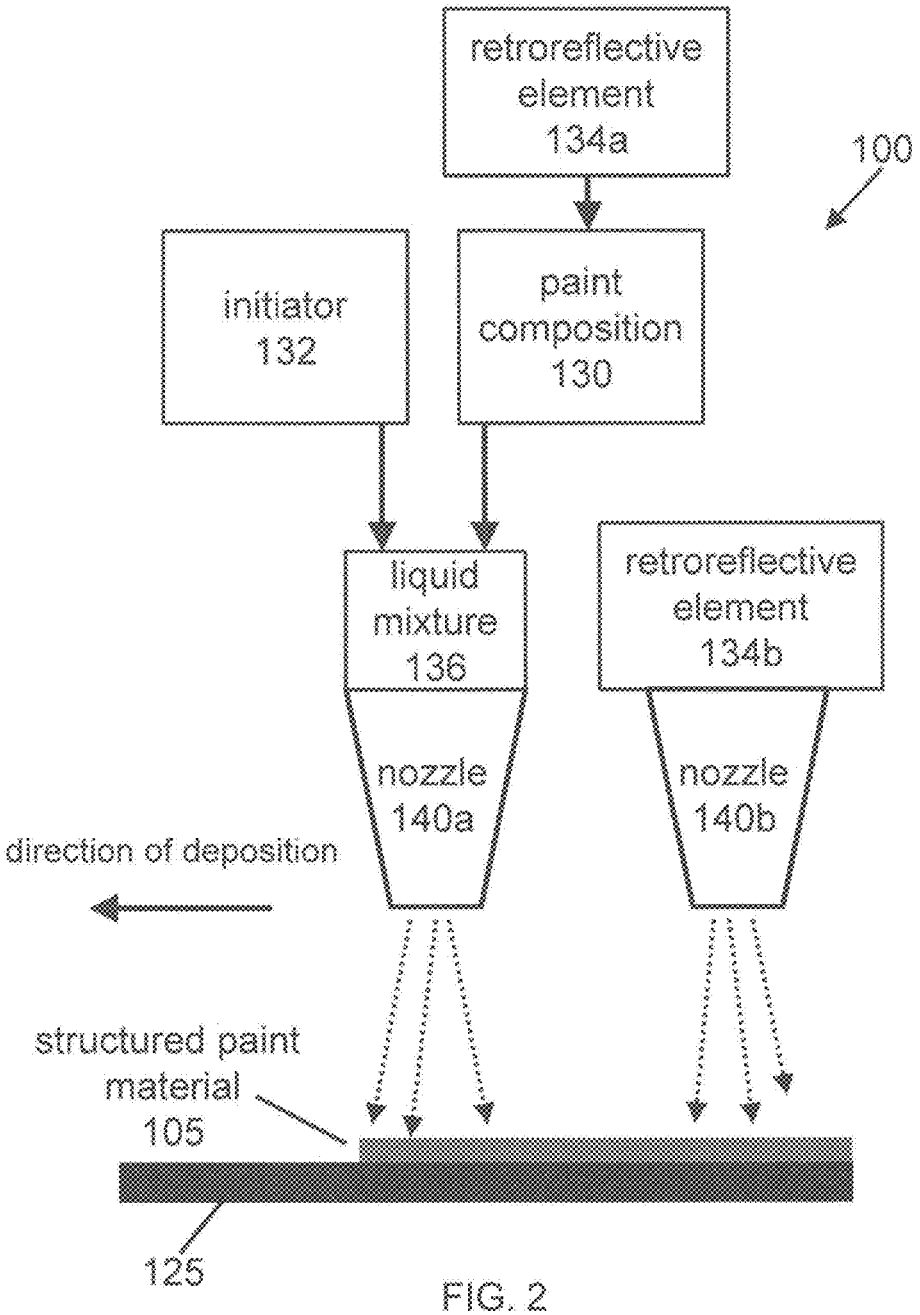
FIG. 2 is a flow diagram illustrating a method for depositing a layer of structured paint material according to one or more aspects of the present invention.

Referring to FIG. 2, there is illustrated a flow diagram of one example of a method 100 for depositing a layer of paint composition according to certain aspects and embodiments. According to at least one embodiment, the disclosed plural marking system comprises a paint composition 130, an initiator 132, and retroreflective element 134*a* that are combined to produce a layer of structured paint material 105. Each of these elements is discussed below in further detail.

Paint Composition

According to at least one embodiment, the layer of structured paint material 105 comprises a paint composition 130. According to various aspects, paint composition 130 comprises a synthetic resin that functions as a binding material for the retroreflective element 134. The synthetic resin may be a reactive resin that comprises crosslinking agents that react when placed in contact or are otherwise activated by the initiator 132 (discussed further below).

In accordance with some embodiments, the synthetic resin of the paint composition 130 comprises methacrylate, which is also a material that complies with federal standards for runway and taxiway markings, such as the aforementioned FAA standard AC 150/5370-10G. Generally speaking, methacrylate refers to derivatives of methacrylic acid, including the parent acid, salts, esters, and the polymers of these species. For example, according to some embodiments, the synthetic resin comprises methyl methacrylate (MMA), which is an ester of methacrylate. Suitable synthetic resins comprising MMA are available from Evonik Roehm GmbH (Germany) under the trade name Degaroute®. Other materials may also be added to the commercially available synthetic resin to form the paint composition 130, as discussed further below. One advantage of MMA is that it contains no volatile solvents, which are banned in many regions. According to some embodiments, the paint composition 130 comprises at least 1% by weight MMA. For instance, in certain embodiments, the paint composition 130 comprises at least 2% MMA; at least 3% MMA; at least 5% MMA; at least 10% MMA, at least 15% MMA; at least 20% MMA; at least 30% MMA; at least 40% MMA; at least 50% MMA; at least 60% MMA; at least 70% MMA; at least 80% MMA. According to one embodiment, the paint composition 130 comprises from about 2% to about 70% MMA. Besides MMA polymers and copolymers, other suitable materials include dimethylacrylates, (meth)acrylates, urethane (meth)acrylates, poly(meth)acrylates, and the like.

One or more additional components may also be added to the paint composition 130, such as rheological agents, colorants such as inorganic or organic pigments or dyes, fillers, such as quartzes, calcium carbonate, and other alkaline earth metal carbonates, accelerators, adhesion promoters, leveling aids, wetting agents, dispersing agents, flow-control agents, UV stabilizers, etc. For example, non-limiting examples of fillers include calcium carbonates, barium sulphates, quartzes, silicas, and cristobalites. Non-limiting examples of rheological agents include those that comprise polyhydroxycarboxamides, urea derivatives, salts of unsaturated carboxylic esters, alkylammonium salts of an acidic phosphoric acid derivative, ketoximes, amine salts of p-toluenesulphonic acid, amine salts of sulphonic acid derivatives and aqueous or organic solutions or mixtures of the compounds. Non-limiting examples of UV stabilizers include benzophenone derivatives, benzotriazole derivatives, thioxanthonate derivatives, piperidinolcarboxylic ester derivatives or cinnamic ester derivatives. Suitable accelerators may include aromatic-substituted tertiary amines. Suitable pigments may include titanium dioxide and organic colorants.

As will be appreciated, the amount of additional components included in the paint composition 130 depends on the application. For instance, the amount of colorant used may depend on the color (e.g., white vs. black), the desired properties of the resulting cured paint material, and the conditions at the time of application. For instance, according to one embodiment, the paint composition 130 comprises at least 1% by weight of colorant, at least 20% by weight of filler material, and less than 5% dispersing agents.

In accordance with at least one embodiment, the paint composition 130 may also include a retroreflective element 134*a*, as discussed further below. In certain instances, integrating the retroreflective element 134*a* into the body of the paint composition 130 enhances the retroreflective properties of the cured paint material, especially after an initial outer layer (i.e., after deposition) of the composition wears away. According to some embodiments, the paint composition 130 comprises at least 20% by weight retroreflective element 134*a*. For instance, according to some embodiments, the paint composition 130 comprises retroreflective element 134*a* in a range from about 20% to about 90%. In one embodiment, the paint composition 130 comprises at least 40% by weight retroreflective element 134*a*.

Initiator

In accordance with certain embodiments, the initiator 132 functions to react with the synthetic resin in the paint composition 130 to produce a polymer. As will be understood by those skilled in the art, the paint composition 130 thus hardens via free-radical polymerization (which is initiated by the initiator 132). Non-limiting examples of initiators include free radical catalysts such as UV light, thermal effects, such as heat, and peroxides. In some embodiments, the initiator 132 may be a liquid or powder catalyst.

According to embodiments that include MMA in the synthetic resin, the initiator 132 may be a peroxide, including halogen-free peroxides such as benzoyl peroxide, ditertiarybutyl peroxide, ditertiaryamyl peroxide, dilauroyl peroxide, tert-butyl peroctoate, tert-butylperoxy 2-ethylhexyl carbonate, and the like.

Other suitable initiators besides peroxides include azo compounds, such as azobis-(isobutyronitrile).

Retroreflective Element

According to some embodiments, the retroreflective element 134*a* and 134*b* functions to give the deposited structured paint material 105 its retroreflective properties. In various embodiments, the retroreflective element 134*a* and 134*b* includes glass beads. The glass beads may be generally spherical in shape, and in some embodiments, may be disc and/or cylindrical in shape, although other shapes are also within the scope of this disclosure. The glass beads may be made from materials capable of exhibiting retroreflective properties, such as quartz, soda lime, borosilicate, phosphosilcate, aluminosilicate, and aluminoborate glasses and non-vitreous ceramic materials. The glass beads may also be solid beads, i.e., not hollow. In certain instances, the glass beads may also include a dopant, such as a material from the lanthanide elements, which may allow them to fluoresce or photoluminesce under certain lighting conditions. According to some embodiments, the glass beads may be coated with an additional material to enhance their reflective and/or adhesive properties. For example, the retroreflective element may be coated with a layer of silane. According to other embodiments, the retroreflective element is not coated.

In various embodiments, the physical characteristics of the glass beads comply with the standards set out by Federal Highway Administration Specification TT-B-1325D, and are explained in the Innovative Pavement Research Foundation—Report IPRF 01-G-002-05-1, published in September 2008. For example, Type I beads may be made from reclaimed glass, have an index of refraction from 1.05 to 1.55, and at installation typically yield retroreflectivity values of 300-450 mcd/m$^2$/lux for white markings, and 175-250 mcd/m$^2$/lux for yellow markings. Type III beads may be made from virgin glass, and have a high index of refraction, with values ranging from 1.90 to 1.93, which in certain instances results in a more concentrated beam of returned light over beads with a lower index of refraction. This allows for more light to be directed back into the pilot's field of vision, and thus yields a longer preview distance (the higher the retroreflectivity, the brighter the marking appears, and the further away it can be seen). Type III beads typically yield retroreflectivity values (at installation) of 600-1300 mcd/m$^2$/lux for white markings, and 350-550 mcd/m$^2$/lux for yellow markings. They also require a distribution, i.e., coverage rate, of ten pounds per gallon due to their high specific gravity. Type IV beads may be made from reclaimed glass and are larger in size (diameter of about 1 mm or more) than Type I or Type III beads. Type IV beads typically yield retroreflectivity values (at installation) of 350-500 mcd/m$^2$/lux for white markings, and 200-350 mcd/m$^2$/lux for yellow markings.

According to at least one embodiment, the methods disclosed herein may use one or more of Type I, Type III, and Type IV glass beads as discussed above. In one embodiment, Type I beads are used as the retroreflective element. The glass beads may have an index of refraction of about 1.5-1.55, and in certain instances, glass beads of different refractive indices may be included in the layer of paint composition. For instance, beads with a lower index of refraction may be applied to an upper surface of the structured paint material, as discussed further below in reference to FIG. 2. In another embodiment, Type III beads are used as the retroreflective element, which may have an index of refraction of about 1.9-2.3. Beads suitable for the methods disclosed herein are commercially available from Potters Industries, Inc. of Malvern, Pa., or Swarco Vestglas GmbH. According to some embodiments, glass beads may be used as the retroreflective element 134*a*, and may be applied at deposition rates having a minimum of 14 pounds per gallon for Type I, 15 pounds per gallon for Type IV, and 20 pounds per gallon for Type III. For example, in reference to FIG. 2, these deposition rates may be used to form the layer of structured paint material 105 that is deposited on the substrate 125, i.e., the rate from nozzle 140*a*. In accordance with another embodiment, Type I glass beads may be used that have an index of refraction of at least 1.5, and a sieve size of less than 70. For instance, the glass beads may be sized to have a sieve size of from 40-70. According to some embodiments, the glass beads comprising retroreflective element 134*a* that are added to the paint composition 130 may comply with FAA standard AC 150/5370-10G (mentioned above), which requires a minimum of 30% (by weight) of glass beads that conform to Type I and Type IV as specified in Federal Highway Administration Specification TT-B-1325D. According to a further embodiment, the glass beads comprising retroreflective element 134*b* that are applied to the surface of the structured paint composition 105 may also comply with FAA standard AC 150/5370-10G, which requires silane-coated beads with a minimum refractive index of 1.5 and are sized according to following gradation table:

TABLE A

Example Size Gradation Requirements for Beads Comprising Retroreflective Element 134b

| Size Gradation | | | |
|---|---|---|---|
| U.S. Mesh | micron (μm) | Retained, % | Passing, % |
| 12 | 1700 | 0-2 | 98-100 |
| 14 | 1400 | 0-3.5 | 96.5-100 |
| 16 | 1180 | 2-25 | 75-98 |
| 18 | 1000 | 28-63 | 37-72 |
| 20 | 850 | 63-72 | 28-37 |
| 30 | 600 | 37-77 | 23-33 |
| 50 | 300 | 89-95 | 5-11 |
| 80 | 200 | 97-100 | 0-3 |

Although the examples above include glass beads as the retroreflective element, other types of retroreflective materials are also within the scope of this disclosure, such as microprisms.

Process

Referring back to the flow diagram of FIG. 2, one example implementation of a method for depositing a layer of the structured paint material 105 is shown. The process comprises mixing or otherwise combining the initiator 132 with the paint composition 130 to form a liquid mixture 136. As mentioned above, according to some embodiments, the retroreflective element 134*a* may be added or otherwise included in the paint composition 130, as shown in FIG. 2.

The paint composition 130 and the initiator 132 may be mixed or combined according to any one of a number of different techniques For instance, according to some embodiments, the first nozzle 140*a* is configured as a static mixer, in that the initiator 132 is continuously blended into the paint composition 130 without the aid of any moving parts. In accordance with some embodiments, both the paint composition 130 and the initiator 132 may be delivered under pressure to nozzle 140*a*. The energy for mixing may therefore come from a loss in pressure as the initiator 132 and paint composition 130 flow through the first nozzle 140*a*. For instance, the initiator 132 and the paint composition 130 may be continuously fed into one end of the nozzle 140*a*, and the interior of the nozzle may be configured to randomize the distribution of the two materials through the use of a number of cavities and/or channels. The cavities and/or channels may form a "honeycomb" inner structure of the first nozzle 140*a* that functions to displace the initiator and paint composition in random directions. Thus, according to some embodiments, introducing the initiator to the paint composition may comprise randomly distributing the initiator and the paint composition within the nozzle, and randomly distributing the initiator and paint composition may comprise introducing the initiator and the paint composition to one or more fluid channels that are configured to randomize the distribution of the initiator and the paint composition within nozzle 140*a*. Once the two materials mix, they agglomerate and exit the second end of nozzle 140*a* to create a splatter pattern that forms the layer of structured paint material 105. Thus, according to some embodiments, the static mixing effect created by the configuration of the nozzle 140*a* may not only function to combine or premix the initiator 132 with the paint composition 130, but may also contribute to creating the splatter pattern of the deposited layer when the mixture is ejected from nozzle 140*a*. The only power required for nozzle 140*a* may therefore be the external pumping power that propels the initiator 132 and paint composition 130 through the nozzle 140*a*.

As will be recognized by those skilled in the art, the amount of initiator 132 added to the paint composition 130 will depend not only on the materials involved, but also the particular application, and the conditions (e.g., environmental conditions, substrate conditions) at the time of application. In instances where MMA is used, the weight ratio of paint composition 130 to initiator 132, such as benzoyl peroxide, in the liquid mixture 136 may range from 99-80:1-20. In one embodiment, the weight ratio of paint composition 130 to initiator 132 is 98:2. According to another example where MMA is used, the volume ratio of paint composition 130 to initiator 132 in the liquid mixture 136 may be about 33:1.

According to at least one embodiment, the paint composition 130 may have a Daniel flow value in a range from 10-16 before the addition of the retroreflective element 134*a* (as determined by the "Daniel Flow Point Method" described, for example, in "Paint Flow and Pigment Dispersion," by T. C. Patton). For example, according to some embodiments, the paint composition 130 (without the retroreflective element 134*a*) may have a Daniel flow value in a range from 12-15. According to some embodiments, the paint composition 130 (with retroreflective element 134*a*) may have a density of about 16.5 lb/gallon (1.98 kg/L).

According to some embodiments, the liquid mixture 136 is deposited on a surface of a substrate 125 immediately after forming the liquid mixture 136 from the initiator 132 and the paint composition 130. As shown in FIG. 2, the liquid mixture 136 may be dispensed through a first nozzle 140*a* that is configured to spray the liquid mixture 136 onto a surface of the substrate 125 to form a layer of the structured paint material 105.

In accordance with at least one embodiment, the retroreflective element 134*a* may also be added to the paint composition 130 and deposited as part of the structured paint material 105. In addition, according to some embodiments, the retroreflective element 134*b* may be applied through a second nozzle 140*b* directly after the deposition of the liquid mixture 136, as discussed further below. According to several embodiments, the retroreflective element may be added to both the paint composition 130 (and thus the liquid mixture 136) and then also deposited separately through the second nozzle 140*b* onto the layer of structured paint material 105. For instance, retroreflective element 134*a* may be added to the paint composition 130 and mixed in to distribute the retroreflective element 134*a* throughout the paint composition 130, which is then mixed with initiator 132 to create liquid mixture 136 and deposited as a layer onto the surface of the substrate 125. Immediately thereafter (before the liquid mixture has a chance to cure), retroreflective element 134*b* may be deposited on the top surface of the layer of the structured paint material 105. Retroreflective element 134*b* may thus further enhance retroreflectivity, and performing this application before the paint composition cures helps ensure that the retroreflective element 134*b* will be properly embedded in the deposited layer. For example, according to some embodiments, the retroreflective element

134*b* is embedded such that at least 50% of the volume of the retroreflective element 134*b*, such as a glass bead, is embedded in the surrounding material comprising the paint material.

As noted above, the paint composition 130 may comprise a retroreflective element 134*a*, such as glass beads. For instance, according to some embodiments, the amount of retroreflective element 134*a*, such as glass beads, is from about 20% to about 90% by weight of the paint composition 130. For example, according to some embodiments, the paint composition 130 comprises from about 30% to about 60% by weight retroreflective element 134*a*. In accordance with at least one embodiment, the paint composition 130 comprises from about 40% to about 50% by weight retroreflective element 134*a*.

In accordance with some embodiments, the nozzles 140*a*, and 140*b* may be included as part of a larger apparatus. The apparatus may include separate chambers or holding tanks for the paint composition 130 and the initiator 132. In certain instances, the components of the paint composition 130 may be mixed separately and then introduced to the apparatus. As will be appreciated, the spray distance from the substrate 125 will depend on several factors, including the width of the desired spray pattern and environmental conditions at the time of application. According to some embodiments, the nozzle 140*a* (or 140*b*) may be adjusted up or down, thereby increasing or decreasing the spray distance to adjust the spray pattern that forms the layer of structured paint material 105.

According to some embodiments, the layer of deposited structured paint material 105 may have a thickness in a range of about 0.01 inches to about 0.250 inches. In some embodiments, the average thickness of the layer of structured paint material 105 is in a range of about 0-0.5 inches. According to at least one embodiment, the average thickness of the layer of structured paint material 105 is in a range of about 0-0.25 inches. In at least one embodiment, the average thickness is in a range of about 0.09-0.125 inches. As used herein, the term "layer" when used in reference to the deposited paint composition and structured paint material refers to the paint composition and structured paint material covering a desired area, and is not intended to be limiting in the sense that the deposition area may have regions where there is no deposited paint material. For instance, according to some embodiments, coverage of the surface of the substrate 125 is at least 50%, and in certain instances may be 100%. According to some embodiments, the coverage is in a range from about 70% to about 90%. According to at least one embodiment, the coverage is about 80%. In certain embodiments, the nozzle 140*a* is configured to produce a splatter pattern or deposition layer that achieves an average thickness in a range of about 0.09 inches to about 0.125 inches with a nominal coverage of about 80%.

Depending on the paint composition and conditions at the time of application, the pot life is at least 10 minutes and can be as long as 60 minutes. By pot life is meant that span of time beginning with the components of the structured paint material, i.e., the initiator and paint composition, are blended together and during which the blended system remains in a workable or manipulative state as the cure of the structured paint material progresses. It ends when the system becomes unworkable. According to some embodiments, the pot life is about 15 minutes at an application temperature (i.e., surrounding air temperature) of about 25° C.

According to certain embodiments, the paint composition may be applied at a rate of about 120 ft/gallon with a spray pattern that is six inches wide, giving a rate of 60 $ft^2$/gal. For example, in embodiments where MMA is used, the layer of structured paint material 105 may be deposited to result in a layer with a thickness in a range from 0-0.25 inches at a rate of 60 $ft^2$/gal.

In accordance with some embodiments, the substrate 125 is a runway or roadway used for air and land vehicles such as airplanes and automobiles. The substrate 125 may therefore be asphalt, concrete, and the like, as recognized by those skilled in the art. According to some embodiments, the surface of the substrate 125 is dry, fully cured, and may be cleaned before the layer of structured paint material 105 is deposited. To ensure proper adhesion, in certain instances the disclosed paint compositions should not be applied to substrates 125 that have been subjected to sealant, such as seal coated materials, such as seal coated asphalt or concrete. The sealant may interfere with the ability of the structured paint material 105 to properly adhere to the substrate 125. According to a further embodiment, the layer of structured paint material may be applied to a surface of an already existing layer of paint material. For example, a pavement marker that fails to meet the standards for retroreflectivity may receive a layer of the disclosed paint composition. This allows for older markings to be resurfaced.

Curing time begins with the addition of the initiator. Depending on the materials used to form the structured paint material, such as the initiator 132 and the paint composition 130, and the application conditions (e.g., temperature and humidity), the curing time for the layer of structured paint material 105 is in a range from 15 minutes to about 45 minutes. According to some embodiments, the curing time for the layer of structured paint material 105 is in a range from about 15 minutes to about 30 minutes. For instance, according to one embodiment, the cure time is about 15 minutes at a temperature of 25° C. According to at least one embodiment, the cure time for the paint materials is not dependent upon application (i.e., ambient) conditions, such as temperature, humidity, etc. For instance, unlike many typical systems that use epoxies, the paint compositions disclosed herein do not require heat curing. Therefore, the disclosed paint composition may be ideal for applications at sub-freezing temperatures. According to one embodiment, the paint compositions may be applied at temperatures as low as −40° C. For example, in one embodiment, the paint composition may be applied at a temperature of −46° C.

Referring back to FIG. 2, after the liquid mixture 136 has been applied as the layer of structured paint material 105, and before the composition completely cures, a layer of retroreflective element 134*b* may be added to the top surface of the layer of structured paint material 105. For example, a second nozzle 140*b* may be used to apply glass beads immediately after the layer of structured paint material 105 is deposited. The layer of glass beads comprising retroreflective element 134*b* may be added at a rate according to FAA standard AC 150/5370-10G, which requires a rate of one lb (±10%) per 10 $ft^2$. According to some embodiments, the layer of glass beads comprising retroreflective element 134*b* may be added at a rate of 7 lb beads/gallon. In instances where glass beads are used, the glass beads may be of a different type or types than those added to the paint composition 130. For instance, in some embodiments, the glass beads added to the top surface of the structured paint material may be larger or smaller in size, and/or beads with a higher or lower index of refraction. In other instances, the same type or types (i.e., material and size) as those added to the paint composition 130 may be used. The retroreflective element 134*b*, such as glass beads, may be deposited such that at least 50% of the volume of the retroreflective element 134*b* is embedded in the surrounding material comprising the layer of structured paint material 105 formed by the deposited liquid mixture 136. According to at least one embodiment, the retroreflective element 134*b* is deposited such that at least 60% of its depth or diameter is embedded in the top surface of the layer of structured paint material 105. For instance, according to some embodiments, the retroreflective element 134*b* is deposited such that each bead is embedded to a depth of at least 60% of a diameter of each bead. In certain embodiments, the retroreflective element 134*b* may be deposited such that each bead is embedded to a depth of approximately 60% of the diameter of each bead. Depositing the retroreflective element 134*b* immediately after the liquid mixture 136 is deposited and before the layer of structured paint material 105 fully cures helps ensure that the retroreflective element 134*b* is properly embedded, and won't mechanically separate from the surface prematurely.

The paint composition may be deposited in any one of a number of different patterns, including lines and shapes, such as dots or squares, or any other design suitable for a specific application. The layer of structured paint material 105 cures to form a hard mass that is resistant to mechanical abrasion in both dry and wet conditions, is UV resistant, and is color consistent. According to some embodiments, the cured layer of paint composition has a Shore D hardness of at least 40. The cured layer of structured paint material may also be hydrophobic. For example, the topography of the surface of the deposited layer and/or the materials used that comprise the structured paint material may repel water such that water runs off the surface to allow the markings to be visible. For instance, water may run off the surface to expose both the retroreflective element and the surrounding material. This hydrophobic quality therefore allows the cured paint compositions that form the structured paint material to be visible during rainstorms.

Figure 3:
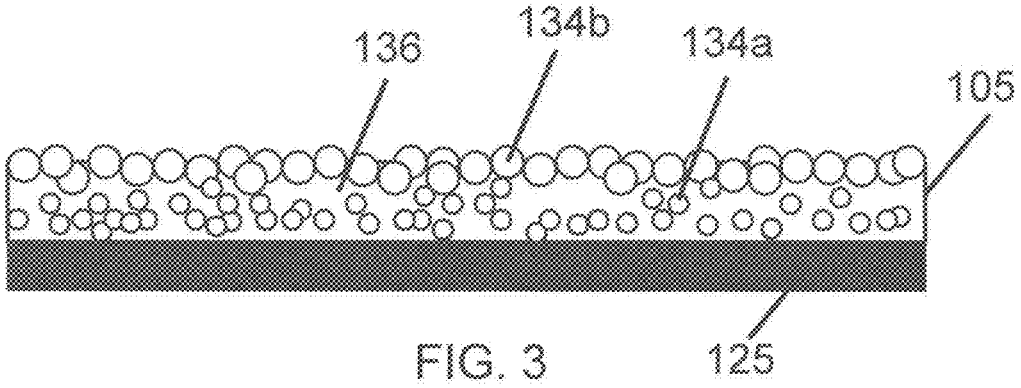
FIG. 3 is a diagram illustrating a cross-sectional view of a layer of paint composition according to one or more aspects of the present invention.

FIG. 3 illustrates one example of a cross-section of a layer of structured paint material 105 deposited on the surface of a substrate 125 using the process described above. This representation is not to scale, but is meant to illustrate the relative components of the deposited layer of structured paint material 105. As shown, the retroreflective element 134*a* comprises glass beads having a first size, which are distributed throughout the depth of the layer 105. Although not shown to be distributed evenly throughout the depth of layer 105, the retroreflective element 134*a* is mixed evenly throughout the paint composition 130 that comprises the deposited layer 105. Retroreflective element 134*b* may comprise beads having a second size, such as larger or smaller beads than those used for retroreflective element 134*a*, and are deposited on the surface of the layer 105 through nozzle 140*b*, as previously discussed. As will be understood by those of skill in the art, the liquid mixture 136 comprising the paint composition 130 and initiator 132 cures and hardens as a solid material around the glass beads. Having the glass beads distributed substantially throughout the layer increases the usable life of the paint composition, since as top layers are removed through external effects such as snowplows, tires or other mechanical or environmental effects (freezing/thawing cycles etc.), a "fresh" layer of beads are revealed to the outer surface, and the retroreflectivity properties of the layer of structured paint material 105 are preserved or may at least be maintained at values that comply with federal standards. According to some embodiments, the disclosed method produces a layer of structured paint material that lasts at least three years. In certain instances, the disclosed method produces a layer of paint composition with a life expectancy that is three to five times that of typical water-based paint compositions used to provide pavement markings.

Figure 4A:
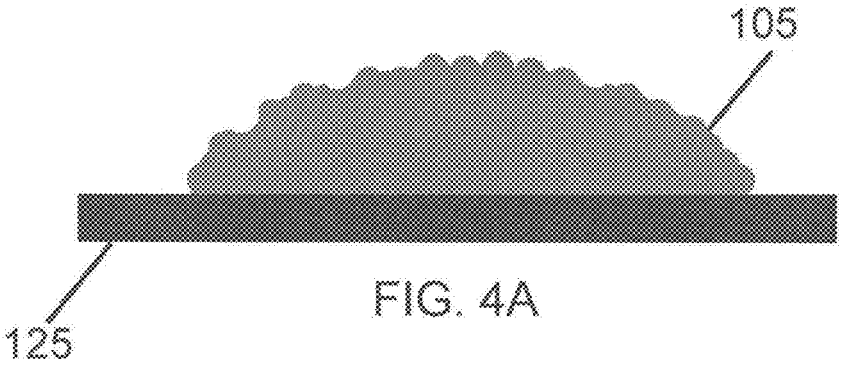
FIG. 4A is a diagram illustrating a first example of a cross-sectional view of a topography of a layer of structured paint material according to one or more aspects of the present invention.
Figure 4B:
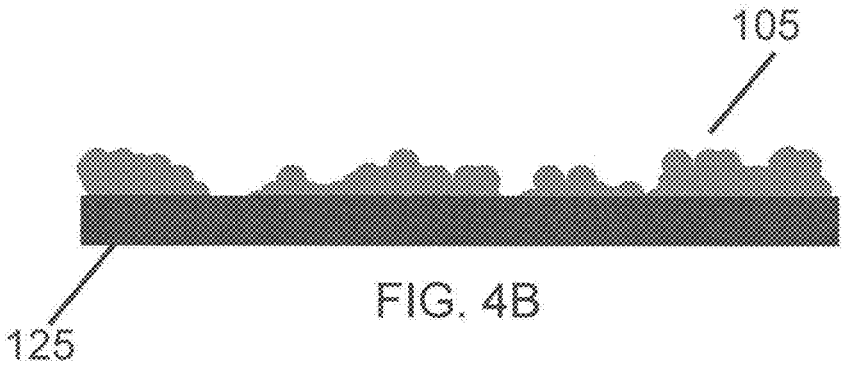
FIG. 4B is a diagram illustrating a second example of a cross-sectional view of a topography of a layer of structured paint material according to one or more aspects of the present invention.
Figure 5A:
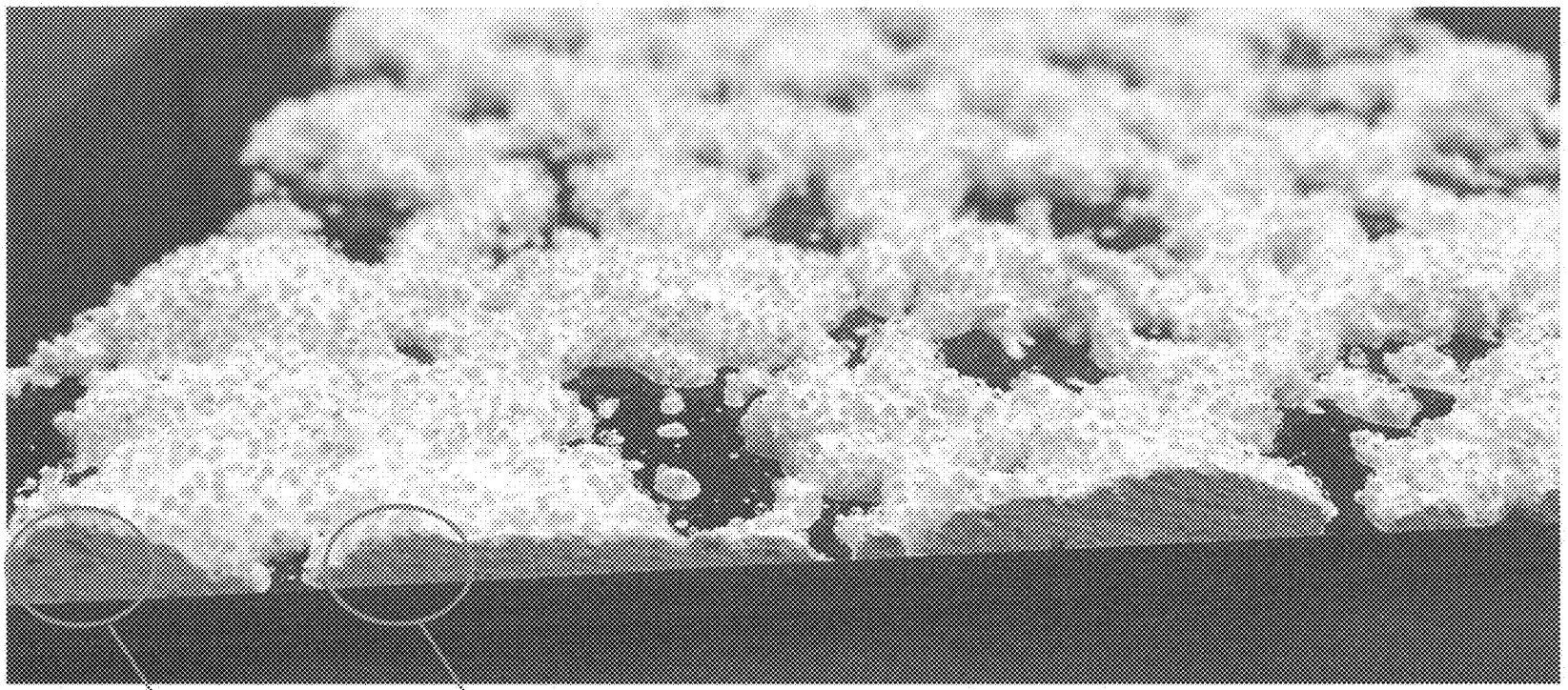
FIG. 5A is a first photograph illustrating a perspective view of a deposited layer of structured paint material in accordance with one or more aspects of the present invention.
Figure 5B:
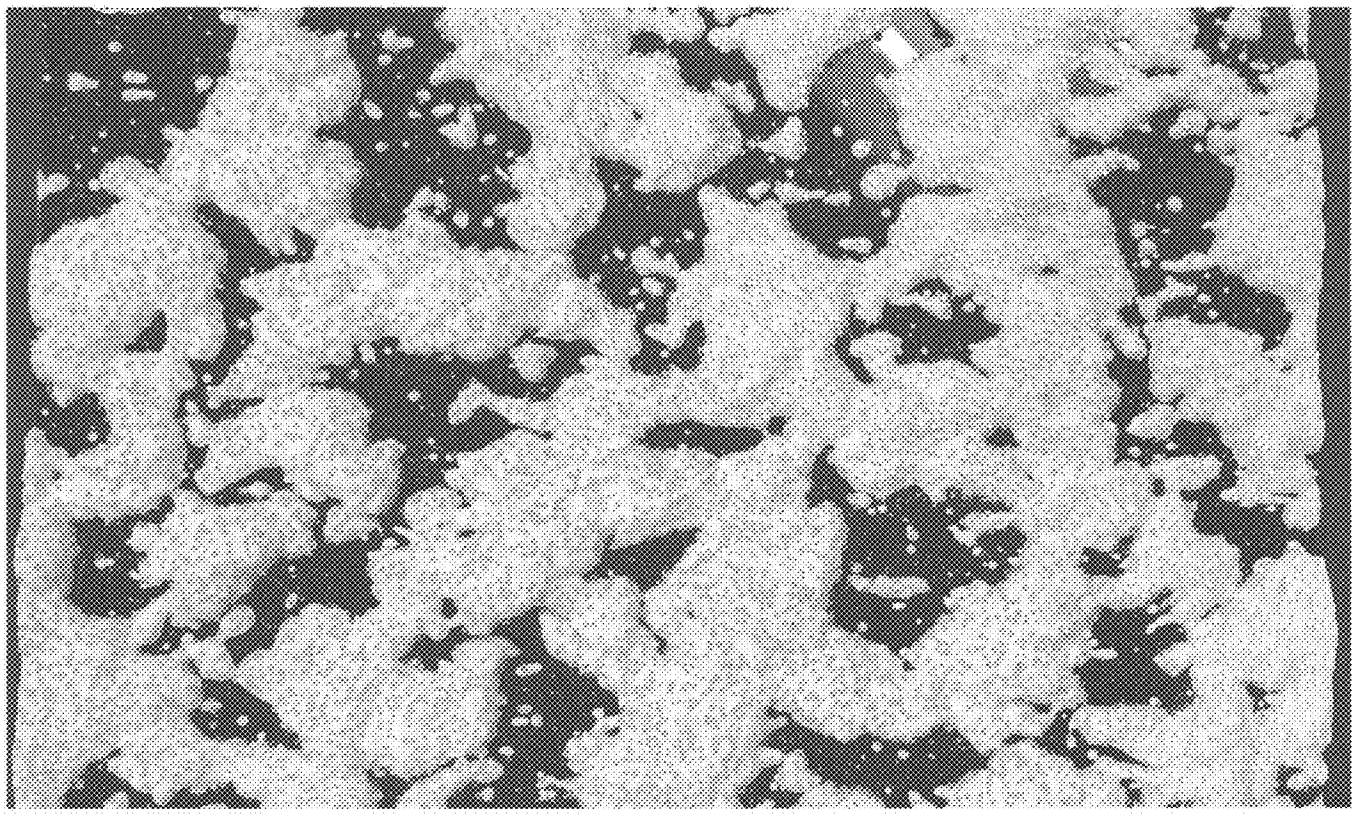
FIG. 5B is a second photograph illustrating a top view of the deposited layer of structured paint material shown in FIG. 5A.

As shown in FIGS. 3, 4A, and 4B, the surface of the layer of structured paint material 105 has a three-dimensional (3D) topography formed from the glass beads being distributed and embedded at different depths and angles within the surrounding hardened paint composition. These figures are not drawn to scale, and are meant to exemplify some of the overall physical characteristics of the final layer of structured paint material. For example, FIG. 4A illustrates one example of a cross-section of the layer of structured paint material. In this instance, coverage of the underlying substrate 125 is 100%, forms an overall hemispherical profile, and the 3D topography of the top surface of the deposited layer is comprised of multiple "hills" and "valleys" formed by the glass beads and cured paint material. FIG. 4B illustrates an example where the coverage is less than 100% (but greater than 50%) and also exemplifies a 3D topography on the surface of the layer of structured paint material 105 comprising multiple hills and valleys. This 3D topography is further exemplified in the cross-sectional view of the deposited layer of structured paint material shown in the photograph of FIG. 5A and the top view shown in the photograph of FIG. 5B. For instance, the depth of the layer of structured paint material at "d1" and "d2" as labeled in FIG. 5A is approximately 5 mm and 3 mm respectively. The distribution and embedding of the glass beads at various angles and depths within the top surface and body of the deposited layer allows for higher reflectivity values. For example, according to certain embodiments, the layer of structured paint material may have a coefficient of retroreflected luminance of at least 1400 $mcd/m^2/lux$, and in certain instances may have a coefficient of retroreflected luminance of at least 1450 $mcd/m^2/lux$ at the time of installation. In some embodiments, the layer of structured paint material may have a coefficient of retroreflected luminance of at least 1800 $mcd/m^2/lux$ at the time of installation. According to some embodiments, these retroreflectivity values are obtained at observation angles of greater than 1.05° and/or in wet conditions.

Figure 6:
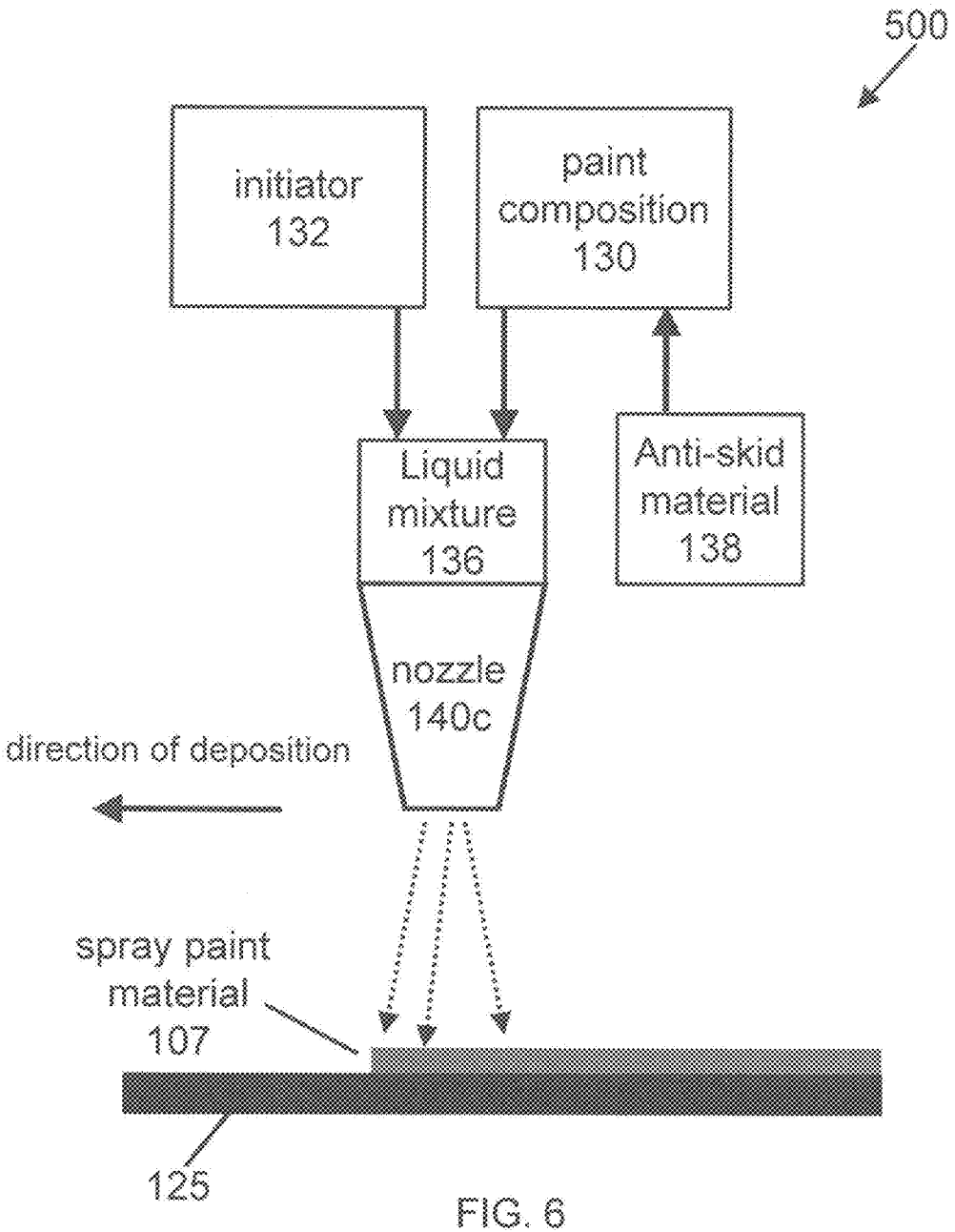
FIG. 6 is a flow diagram illustrating a method for depositing a layer of spray paint material according to one or more aspects of the present invention.

In accordance with another embodiment, the flow diagram illustrated in FIG. 6 represents an example of a method 500 for depositing a layer of spray paint material 107. The spray paint material 107 may use the same paint composition 130 and initiator 132 as the structured paint material 105 discussed above, but includes an anti-skid material 138 instead of the retroreflective element 134*a* and 134*b*. The spray paint material 107 may be useful for applications where anti-skid properties is desired, such as walkways, bikeways, and interiors such as garages or industrial plants. The method is somewhat similar to the process discussed above in reference to FIG. 2, in that an initiator 132 may be combined with a paint composition 130 to form the liquid mixture 136, except an anti-skid material 138 is added to the paint composition 130 instead of retroreflective element 134*a*. Also, according to the embodiment shown in FIG. 6, the use of a second nozzle is not necessary since the anti-skid material may incorporated only in the paint composition. However, in some embodiments, a top layer of anti-skid material 138 may be added onto the upper surface of the spray paint material 107 using a second nozzle in a similar way as retroreflective element 134*b* is added to the upper surface of the structured paint material 105. Non-limiting examples of suitable anti-skid materials 138 include non-skid aggregates, such as silicon dioxide, aluminum oxide, magnesium oxide, amorphous glass, quartz, etc. In accordance with some embodiments, the paint composition 130 in FIG. 6 may have a Daniel flow value in a range from 10-16 before the addition of the anti-skid material 138. The pot life for the liquid mixture forming the spray paint material 107 is slightly shorter than that for the structured paint material described above in reference to FIG. 2. For instance, depending on the paint composition and conditions at the time of application, the pot life may be in a range from 7 minutes to about 35 minutes.

The nozzle 140*c* used to dispense the layer of spray paint material 107 may include at least one mixing chamber that is configured to turbulently mix the initiator 132 and paint composition 130. Thus turbulent flow drives the dispersion and mixing of the initiator and paint composition, and both materials may be delivered to nozzle 140*c* under pressure. The initiator 132 may be added to the paint composition 130 in the same proportions as discussed above in reference to the structured paint material 105.

EXAMPLES

The systems and methods described herein will be further illustrated through the following examples, which are illustrating in nature and are not intended to limit the scope of the disclosure.

Example 1—Paint Composition and Process

Examples of paint compositions were prepared according to the process outlined in FIG. 2 and the materials listed below in Table 1. For example, each of the materials listed in Table 1 may be a component of the paint composition 130 discussed above.

TABLE 1

Example Components of Paint Composition

| Paint Composition | Percent by Weight (%) |
|---|---|
| Commercially available synthetic resin comprising at least 20% MMA | 10-30 |
| Dispersion aid | 0-5 |
| Rheological additive | 0-5 |
| Colorant | 1-30 |
| Filler | 20-40 |
| Uncoated glass beads, sieve size 40-70 | 30-60 |

According to some examples, the commercially available synthetic resin may be obtained from Evonik Roehm GmbH (Germany) under the trade name Degaroute®. For example, Degaroute® 465 is a cold plastic MMA that constitutes a reactive resin comprising about 68% by weight of monomers (MMA), about 27% by weight of polymethacrylate binders, and about 1.6% by weight of a crosslinking agent, as well as an accelerator and additives, such as waxes, stabilizers, and leveling aids.

Suitable dispersion and rheology additives may be commercially available from BYK Chemie GmbH (Germany) and Elementis GmbH (Germany).

Colorants, such as titanium dioxide, may be commercially available from Tronox Corporation, Oklahoma City, Okla.

Fillers, such as calcium carbonate, may be commercially available from Omya, Inc. (North America).

Glass beads having a U.S. standard sieve size of 40-70 (diameter of 0.0165 inches to 0.0083 inches) and a refractive index of at least 1.5 function as a retroreflective element, and may be commercially available from Potters Industries, Inc. of Malvern, Pa.

The materials listed in Table 1 above were mixed at room temperature in various proportions according to the listed weight percentage to generate a total volume of 4 gallons. According to one example, the density of the mixture was 16.4858 lb/gallon. Samples of the resulting (uncatalyzed) paint composition were measured to yield a Daniel flow value of 11. The contrast ratio (CR) and reflectance over black ($R_B$) were measured by applying a 0.15 mil wet thickness coating film by a Bird blade to give values of 0.99 and 82, respectively, using a measurement method according to ASTM International Standards on Color and Appearance. Benzoyl peroxide was added as an initiator at a weight percent of about 2% to the above composition. Cure time was determined to be approximately 26 minutes and the pot life was about 12 minutes at room temperature (25° C.).

The process depicted in FIG. 2 is one particular sequence of acts in a particular embodiment. Some acts are optional and, as such, may be omitted in accord with one or more embodiments. For example, in some embodiments, the act of dispensing refractive element 134*b* through the second nozzle 140*b* may be omitted. Additionally, the order of acts may be altered, or other acts may be added, without departing from the scope of the embodiments described herein.

Having thus described several aspects of at least one example, it is to be appreciated that various alterations, modifications, and improvements will readily occur to those skilled in the art. For instance, examples disclosed herein may also be used in other contexts. Such alterations, modifications, and improvements are intended to be part of this disclosure, and are intended to be within the scope of the examples discussed herein. Accordingly, the foregoing description and drawings are by way of example only.

What is claimed is:

1. A method of depositing a structured paint material on a surface comprising:

introducing an initiator to a paint composition comprising methyl methacrylate (MMA) and a first retroreflective element to produce a liquid mixture;

depositing the liquid mixture on a surface of a substrate to produce a layer of structured paint material; and depositing a layer of a second retroreflective element onto at least a portion of an upper surface of the deposited layer of structured paint material, wherein the first and the second retroreflective elements comprise a plurality of glass beads and the glass beads of the layer of the second retroreflective element are deposited such that each bead is embedded to a depth of at least 60% of a diameter of each bead and a coefficient of retroreflected luminance of the layer of structured paint material is initially at least 1400 mcd/m$^2$/lux.

2. The method of claim 1, wherein introducing the initiator to the paint composition comprises:

supplying the paint composition and the initiator under pressurized conditions to a first end of a nozzle;

randomly distributing the initiator and the paint composition within the nozzle.

3. The method of claim 1, wherein the coefficient of retroreflected luminance of the layer of structured paint material is initially at least 1800 mcd/m$^2$/lux.

4. The method of claim 1, wherein coverage of the surface of the substrate by the layer of structured paint material is about 80%, and the layer of structured paint material has a thickness in a range of about 0.0 inches to about 0.250 inches.

5. The method of claim 1, wherein the layer of structured paint material has an average thickness in a range of about 0.09 inches to about 0.125 inches.

6. The method of claim 1, wherein the paint composition comprises at least 5% by weight MMA.

7. The method of claim 6, wherein the initiator is a peroxide.

8. The method of claim 7, wherein the weight ratio of peroxide to paint composition in the liquid mixture is in a range from 99-80:1-20.

9. The method of claim 1, further comprising depositing the liquid mixture at a temperature below about 0° C.

10. The method of claim 1, wherein depositing the liquid mixture creates a three-dimensional (3D) topography on a surface of the layer of structured paint material formed at least in part by at least one of the first and the second retroreflective elements.

11. The method of claim 1, wherein the cure time for the deposited liquid mixture is about 15 minutes.

12. The method of claim 1, wherein the layer of structured paint material is deposited to form a pavement marking.

13. A pavement marking formed from a layer of structured paint material comprising methyl methacrylate (MMA) and having a three-dimensional topography created by a plurality of glass beads embedded to a depth of at least 60% of a diameter of each bead in the layer of structured paint material, the layer of structured paint material deposited such that the pavement marking exhibits an initial coefficient of retroreflected luminance of at least 1400 mcd/m$^2$/lux.

14. The pavement marking of claim 13, wherein the layer of structured paint material comprises a paint composition and an initiator, the paint composition comprising at least 5% by weight of the MMA and at least 30% by weight glass beads.

15. The pavement marking of claim 13, having a shore D hardness of at least 40.

16. The pavement marking of claim 13, having a life expectancy of at least three years.

17. The deposition layer of claim 13, wherein the pavement marking exhibits an initial coefficient of retroreflected luminance of at least 1800 mcd/m2/lux.

18. The pavement marking of claim 13, wherein the pavement marking is hydrophobic.

19. The pavement marking of claim 13, wherein the glass beads are constructed from quartz, soda lime, borosilicate, phosphosilcate, aluminosilicate, and aluminoborate glasses or non-vitreous ceramic materials.

* * * * *